US011594392B2

(12) United States Patent
Hetzmannseder et al.

(10) Patent No.: US 11,594,392 B2
(45) **Date of Patent: *Feb. 28, 2023**

(54) FUSE HOUSING FOR SAFE OUTGASSING

(71) Applicant: Littelfuse, Inc., Chicago, IL (US)

(72) Inventors: Engelbert Hetzmannseder, Klosterneuburg (AT); Robert Gawrylo, Mount Prospect, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/523,186

(22) Filed: Nov. 10, 2021

(65) Prior Publication Data

US 2022/0328272 A1 Oct. 13, 2022

Related U.S. Application Data

(63) Continuation of application No. 17/224,583, filed on Apr. 7, 2021, now Pat. No. 11,251,009.

(51) Int. Cl.

| | |
|---|---|
| ***H01H 85/43*** | (2006.01) |
| ***H01H 39/00*** | (2006.01) |
| ***H01H 85/38*** | (2006.01) |
| ***H01H 85/175*** | (2006.01) |

(52) U.S. Cl.

CPC ..... *H01H 85/43* (2013.01); *H01H 39/006* (2013.01); *H01H 85/175* (2013.01); *H01H 85/38* (2013.01)

(58) Field of Classification Search

CPC ..... H01H 39/006; H01H 85/175; H01H 85/1755; H01H 85/38; H01H 85/43; H01H 2085/383

See application file for complete search history.

(56) References Cited

U.S. PATENT DOCUMENTS

| | | | | |
|---|---|---|---|---|
| 4,563,666 A * | 1/1986 | Borzoni | ..... | H01H 85/0411 337/201 |
| 5,229,739 A | 7/1993 | Oh et al. | | |
| 5,287,079 A * | 2/1994 | Bernardi | ..... | H01H 85/0417 337/250 |

(Continued)

FOREIGN PATENT DOCUMENTS

DE 2014100638 U 5/2015

OTHER PUBLICATIONS

Extended European Search Report dated Aug. 9, 2022, for corresponding European Patent Application No. 22166352.9.

*Primary Examiner* — Jacob R Crum
(74) *Attorney, Agent, or Firm* — KDB Firm PLLC

(57) ABSTRACT

A fuse housing for safe outgassing of a fuse is disclosed. The fuse housing features labyrinth walls disposed at opposing sides of the fuse housing. The labyrinth walls feature serpentine paths for the flow of outgassing material. At an end of the serpentine paths which is farthest away from a fuse element are vent channels. The vent channels are narrower in depth than that of the serpentine paths of the labyrinth walls, facilitating a suctioning effect during outgassing. Conductive material deposits along the serpentine paths so that the fuse maintains a high OSR rating. By directing and controlling the outflow of gases, the fuse housing is able to reduce the temperature of the gases produced. The fuse housing is also able to reduce the physical and observable effects of outgassing.

6 Claims, 11 Drawing Sheets

(56) References Cited

U.S. PATENT DOCUMENTS

| | | | | |
|---|---|---|---|---|
| 5,357,234 | A | 10/1994 | Pimpis | |
| 5,426,411 | A * | 6/1995 | Pimpis | H01H 85/165 337/186 |
| 2009/0027155 | A1 | 1/2009 | Arikawa et al. | |
| 2015/0340188 | A1 | 11/2015 | Schmidt et al. | |
| 2016/0141140 | A1 | 5/2016 | Schmidt et al. | |
| 2016/0217960 | A1 * | 7/2016 | Abad | H01H 85/143 |
| 2017/0229266 | A1 | 8/2017 | Cortes et al. | |
| 2018/0138004 | A1 | 5/2018 | Schlaak | |
| 2021/0118639 | A1 | 4/2021 | Betti | |

* cited by examiner

FUSE HOUSING FOR SAFE OUTGASSING

CROSS REFERENCE TO RELATED APPLICATION

This application is a continuation of, and claims the benefit of priority to, U.S. patent application Ser. No. 17/224,583, filed Apr. 7, 2021, entitled "FUSE HOUSING FOR SAFE OUTGASSING," which application is incorporated herein by reference in its entirety.

FIELD OF THE DISCLOSURE

Embodiments of the present disclosure relate to fuse housing and, more particularly, to fusing housing for high-voltage systems.

BACKGROUND

Fuses are current-sensitive devices which are designed as the intentional weak link in an electrical circuit. The function of the fuse is to provide discrete component or complete circuit protection by reliably melting under overcurrent conditions and thus safely interrupting the flow of current.

Fuses are selected based on the environment to be protected. Parameters such as voltage rating, interrupting rating, time-current characteristics, and current rating, to name a few, are considered when selecting a fuse. The voltage rating indicates the maximum voltage of the circuit for which the fuse is designed to operate safely in the event of an overcurrent. The interrupting rating (also known as breaking capacity or short circuit rating) is the maximum current which the fuse can safely interrupt at the rated voltage. The time-current characteristics determine how fast the fuse responds to different overcurrent events. The current rating is the maximum current which the fuse can continuously carry under specified conditions.

A 12V system is one that has a rated voltage of 12V, but may be connected to a fuse having a 32V interruption voltage. This means that, if the 12V system receives 32V, the fuse will break, creating an open circuit, and protecting the devices/components in the 12V system that the fuse is meant to protect. Similarly, a 48V system may have an interruption voltage of 70V, with the appropriate fuse for interrupting the 70 volts being selected for that system.

When the fuse protecting a circuit breaks, an arc energy is created between the two terminals of the fuse. When the fuse starts to open at the interruption voltage, the arc will occur, causing the metal of the breakable portion of the fuse element, as well as other materials, to melt and deposit within the fuse housing and, where the fuse is vented, and possibly outside the housing as well.

Whatever the voltage rating of the fuse, this arc energy occurs. However, the arc energy is much higher for the 70V system than for the 32V system. A 70V system may experience arc energy that is three times as high, or more, than the 32V system. For a 70V voltage system, the housing strength, outgassing, and Open State Resistance (OSR) of the fuse become a significantly higher challenge than for 32V systems.

It is with respect to these and other considerations that the present improvements may be useful.

SUMMARY

This Summary is provided to introduce a selection of concepts in a simplified form that are further described below in the Detailed Description. This Summary is not intended to identify key or essential features of the claimed subject matter, nor is it intended as an aid in determining the scope of the claimed subject matter.

An exemplary embodiment of a fuse housing in accordance with the present disclosure may include a top portion and a bottom portion. The bottom portion has a first labyrinth wall on a left side forming a first path for the movement of outgassing materials from the fuse housing when a fuse element breaks. The bottom portion also has a second labyrinth wall on a right side forming a second path for the movement of outgassing materials from the fuse housing when the fuse element breaks. The fuse housing also has a first vent channel located at a first exit of the first path and a second vent channel located at a second exit of the second path.

Another exemplary embodiment of a fuse housing in accordance with the present disclosure may include a first labyrinth wall on a first side, terminated by a first vent channel, a second labyrinth wall on a second side, terminated by a second vent channel. The first and second vent channels have a first depth and the first and second labyrinth walls have a second depth, and the second depth is substantially larger than the first depth. The fuse housing also has multiple ribs in a central portion which are beneath a fuse element. Outgassing materials consisting of gaseous material, molten metal, and carbonized plastic are sucked through the first and second labyrinth walls during an arc episode such that the molten metal and the carbonized plastic substantially remain in the first and second labyrinth walls while the gaseous material escapes through the first and second vent channels.

An exemplary embodiment of a fuse housing in accordance with the present disclosure may include a bottom portion with a left labyrinth wall and a right labyrinth wall with a center portion in between. The left labyrinth wall has a left vent channel at its end and the right labyrinth wall has a right vent channel at its end. The bottom portion also has a male weld on a top side and a female weld on a bottom side. The fuse housing also has a top portion with a second male weld on a second top side and a second female weld on a second bottom side. The bottom portion is mated with the top portion such that the male weld of the bottom portion mates with the second female weld of the top portion and the second male weld of the top portion mates with the female weld of the bottom portion.

DETAILED DESCRIPTION

A fuse housing for safe outgassing of a fuse is disclosed. The fuse housing features labyrinth walls disposed at opposing sides of the fuse housing. The labyrinth walls feature serpentine paths for the flow of outgassing material. At an end of the serpentine paths which is farthest away from a fuse element are vent channels. The vent channels are narrower in depth than that of the serpentine paths of the labyrinth walls, facilitating a suctioning effect during outgassing. Conductive material deposits along the serpentine paths so that the fuse maintains a high OSR rating. The fuse housing includes support structures for connecting a top and bottom portion as well as supporting the placement of terminals and the fuse element.

Figure 1A:
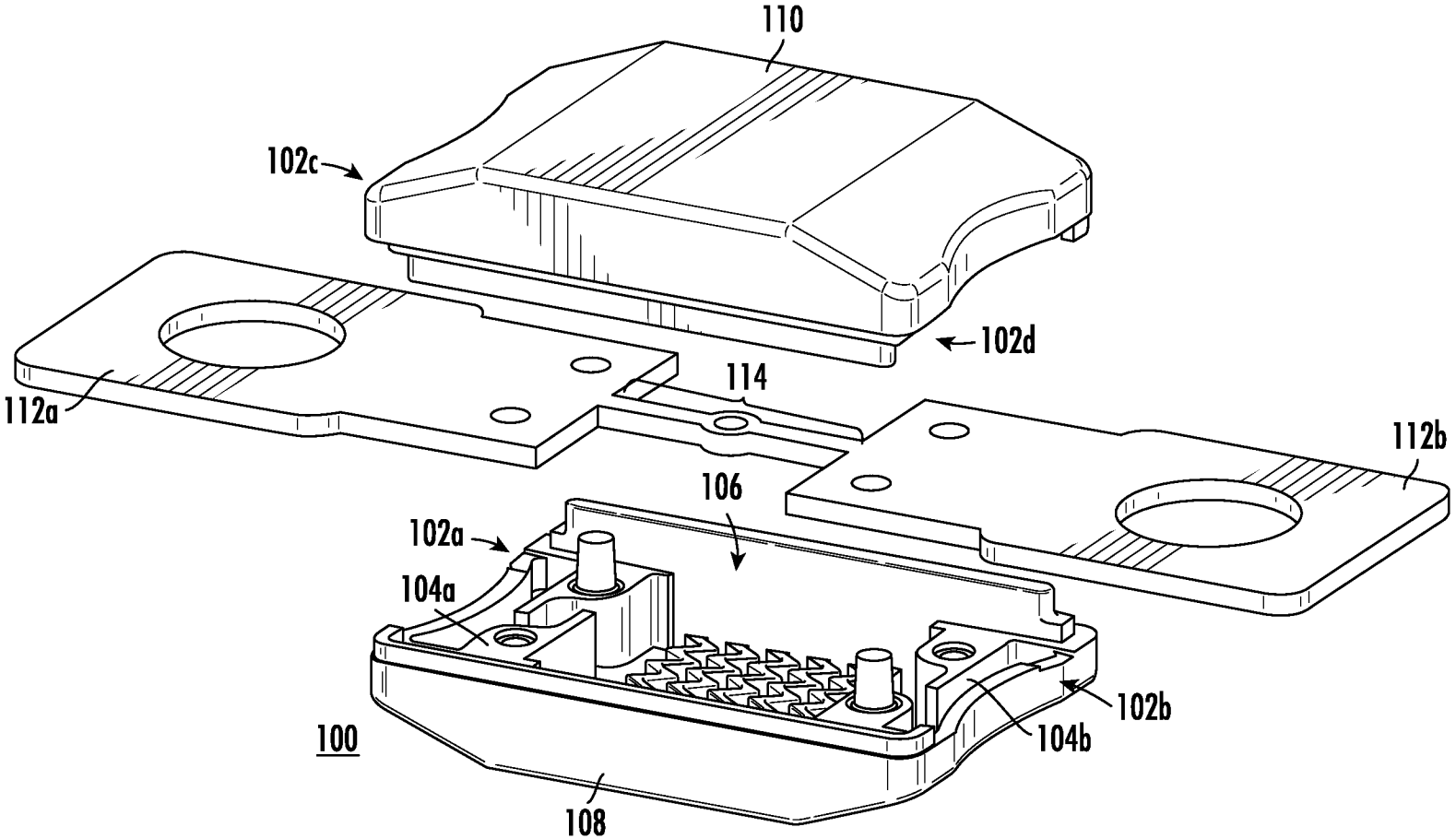
FIGS. 1A-1C are diagrams illustrating a fuse housing, in accordance with exemplary embodiments.
Figure 1B:
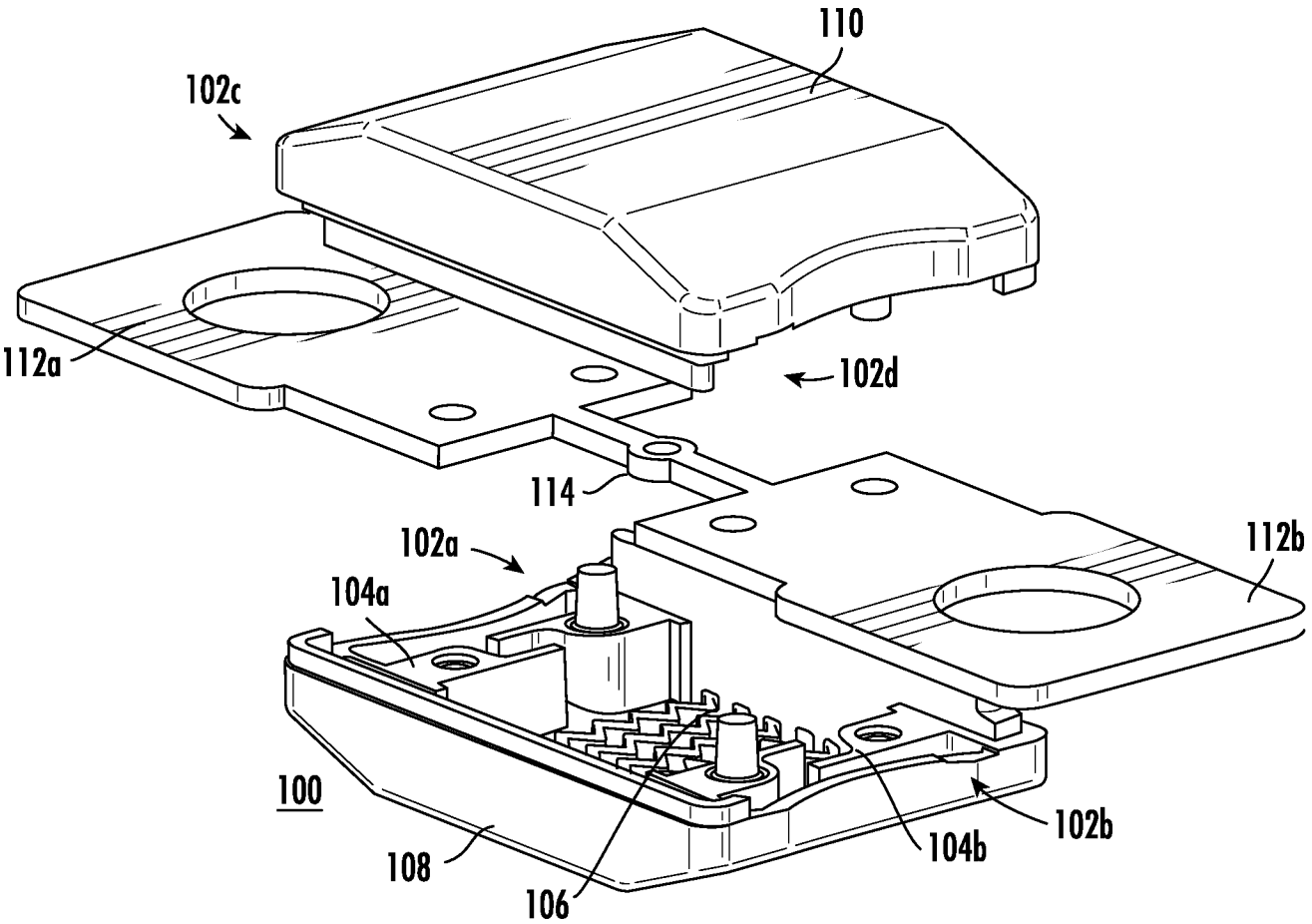
Figure 1C:
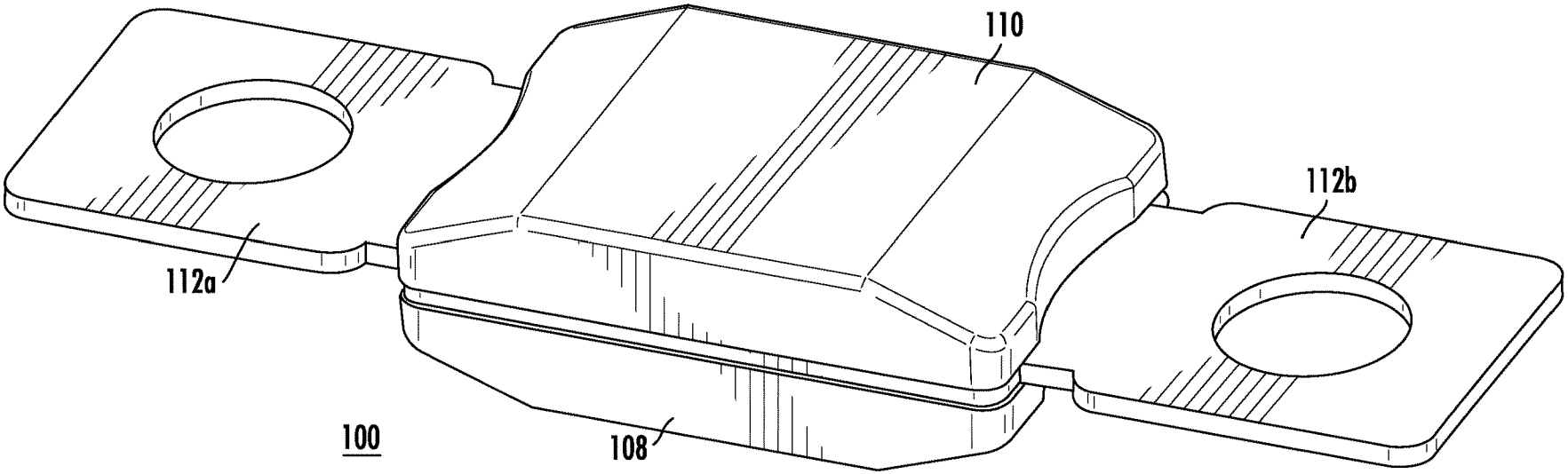

FIGS. 1A-1C are perspective drawings of a fuse housing 100 for safe outgassing, according to exemplary embodiments. FIGS. 1A and 1B are exploded perspective views of the fuse housing 100 while FIG. 1C is a perspective view with the housing in a closed position. The fuse housing 100 includes a bottom portion 108 and a top portion 110 that, together, encase a fuse element 114.

The fuse housing 100 features, on the bottom portion 108, vent channel 102*a* on the left side and vent channel 102*b* on the right side and, on the top portion 110, vent channel 102*c* on the left side (not visible) and vent channel 102*d* on the right side (collectively, "vent channels 102"). The fuse housing 100 also features, on the bottom portion 108, a labyrinth wall 104*a* on the left side and a labyrinth wall 104*b* on the right side (collectively, "labyrinth walls 104"). Similarly, the top portion 110 includes a pair of labyrinth walls (not shown). In exemplary embodiments, the bottom portion 108 and the top portion 110 are substantially similar in shape and configuration. In exemplary embodiments, the vent channels 102 and the labyrinth walls 104 of the novel fuse housing 100 helps to direct the outflow of gases caused by an arc during interruption (breaking of the fuse element). Further, as described in more detail below, the vent channels 102 and labyrinth walls 104 are designed to control the outflow of gases, reduce the temperature of the gases, and reduce the effects of outgassing, such as visible hot gases, blackened surroundings, etc., that result from the arc energy being dissipated as the fuse breaks.

As used herein, outgassing, or outgassing material, refers to gaseous airborne materials, molten materials, and housing plastic. The molten materials may result from the breaking of the fuse element (intentional weak link) inside the fuse or the heating of the fuse terminals, a busbar to which the fuse is connected, or other conductive material nearby. The plastic material making up the housing of the fuse housing 100 will, when exposed to the violent gases of the outgassing occurrence, will turn into carbon, which is semi-conductive.

The condition that causes a fuse to break is known as an overcurrent event. An overcurrent is any current which exceeds the ampere rating of the wiring, equipment, or devices under conditions of use. The term "overcurrent" includes both overloads and short circuits. The voltage rating, as marked on the fuse, indicates the maximum voltage of the circuit for which the fuse is designed to operate safely in the event of an overcurrent.

The fuse housing 100 further includes a fuse element 114, in accordance with exemplary embodiments. A left terminal 112*a* is connected to the fuse element 114 on a left side of the fuse housing 100, while a right terminal 112*b* is connected to the fuse element on a right side of the fuse housing 100 (collectively, "terminals 112"). The fuse element 114 is centrally located within the fuse housing 100 and disposed above ribs 106. The fuse element 114 is the "intentional weak point" of the fuse, designed to break at the rated voltage.

The ribs 106 of the fuse housing 100 are raised portions of a wall of the fuse housing. In the bottom portion 108, the wall would be the bottom or floor, in the case of the top portion 110, the wall would be the top or ceiling (not shown). The fuse element 114 of the fuse is disposed above the ribs 106. Multiple rows of zig-zag-shaped ribs 106 occupy a central portion of the fuse housing 100. However, the ribs 106 may assume any of a variety of shapes besides the zig-zag configuration shown, may be sized differently, and may feature more or fewer rows than are shown. Ultimately, the ribs 106 increase the surface area of the central portion of the fuse housing 100. The ribs 106 may be formed by a molding process when bottom portion 108 and top portion 110 of the fuse housing 100 are formed.

Figure 2:
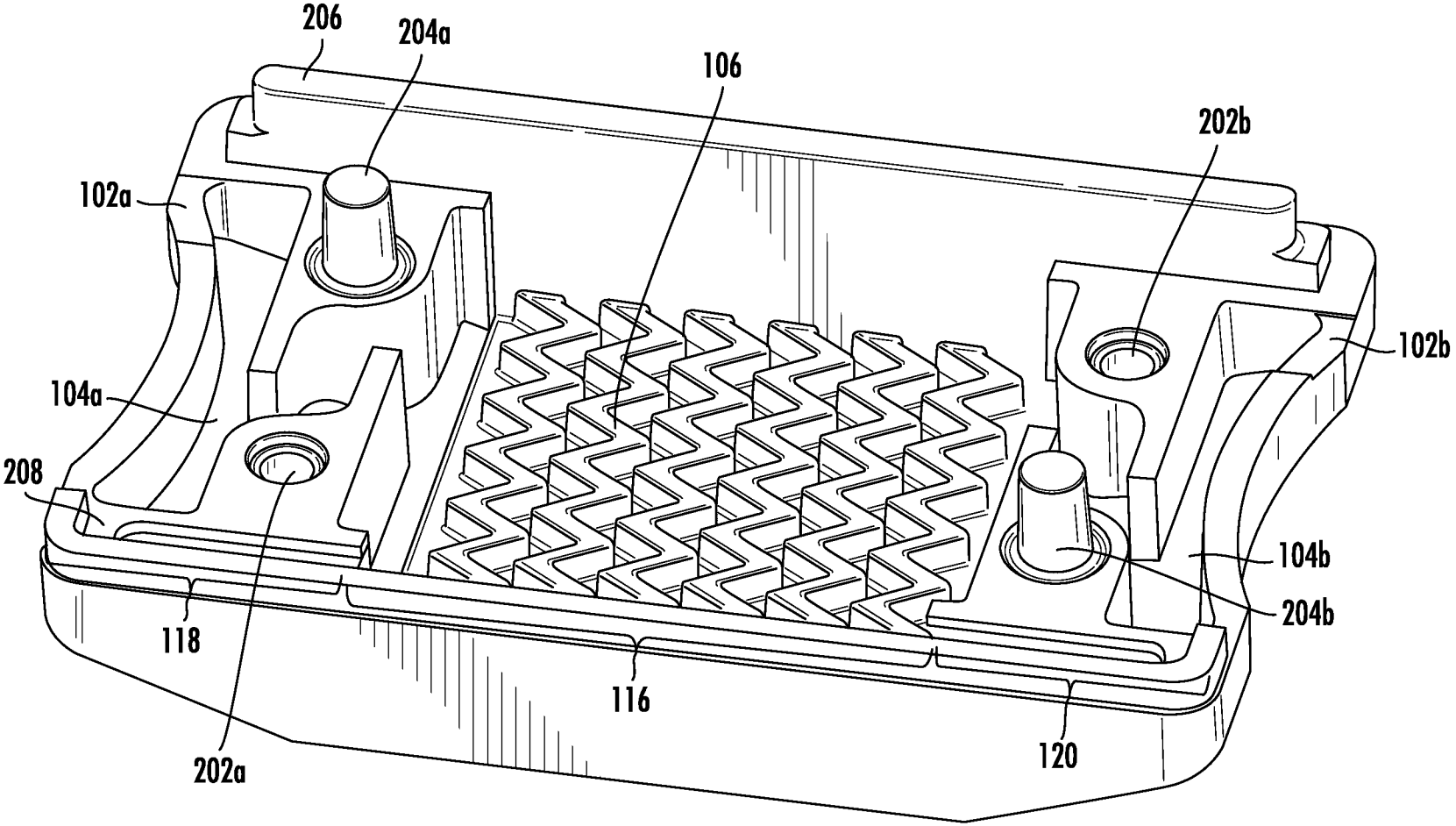
FIG. 2 is a diagram illustrating a bottom portion of the fuse housing of FIGS. 1A-1C, in accordance with exemplary embodiments.

FIG. 2 is a perspective view of the bottom portion 108 of the fuse housing 100 of FIGS. 1A-1C, in accordance with exemplary embodiments. The bottom portion 108 is separated into left labyrinth wall chamber 118, rib chamber 116, and right labyrinth wall chamber 120. Although only the bottom portion 108 is shown, the illustration of FIG. 2 may alternatively be a depiction of the top portion 110, as the two portions 108 and 110 are identical, in exemplary embodiments. The bottom portion 108 of the fuse housing 100 further includes receiving apertures 202*a* and 202*b* (collectively, "receiving apertures 202"), cylindrical protrusions 204*a* and 204*b* (collectively, "cylindrical protrusions 204"), a male weld 206, and a female weld 208. These components are used to secure the bottom portion 108 of the fuse housing to the top portion 110 (FIGS. 1A-1C). In exemplary embodiments, the bottom portion 108 and the top portion 110 are secured by welding. The top portion 110 also includes the receiving apertures 202, cylindrical protrusions 204, male weld 206, and female weld 208. The top portion 110 may be thought of as a mirror image of the bottom portion 108. Or the top portion 110 may be thought of as axially symmetrical to the bottom portion 108. The cylindrical protrusion 204*a* of the bottom portion 108 would fit into a receiving aperture 202 of the top portion 110 and the cylindrical protrusion 204*b* of the bottom portion 108 would fit into a receiving aperture 202 of the top portion 110.

In an exemplary embodiment, the top portion 110 of the fuse housing 100 is identical to the bottom portion 108, and further includes the vent channels 102, labyrinth walls 104, and ribs 106. In an alternative embodiment, the top portion 110 includes some, but not all features of the bottom portion 108. In an exemplary embodiment, the vent channels 102, labyrinth walls 104, ribs 106, receiving apertures 202, cylindrical protrusions 204, male weld 206, and female weld 208, may be formed as a unitary structure by a molding process when the fuse housing 100 is manufactured.

Overcurrent and high voltage conditions can cause unfavorable open-state resistance results. Directing and controlling the outflow of gases caused by the arc during interruption is essential for the performance of a fuse. By directing and controlling the outflow of gases, a well-planned fuse housing design, such as in the exemplary fuse housing 100, is able to reduce the temperature of the gases produced. In an exemplary embodiment, the fuse housing 100 is also able to reduce the physical and observable effects of outgassing.

As explained above, the arc energy to be dissipated in a 48V system is significantly higher than that of a 12V system. Housing strength, outgassing, and Open State Resistance (OSR) become a significantly higher challenge for 48V systems than for the lower voltage systems. Typically listed as a fuse parameter, OSR is a test condition in which the resistance of the fuse is measured after the fuse breaks. Because the purpose of the fuse is to break so as to create an open circuit and protect other circuitry, a broken fuse ideally has as high a resistance as possible, blocking any current from reaching the protected circuitry. A fuse specification may state, for example, "Open State Resistance (after fuse opening)>1 MOhm".

It may be the case, however, that a poorly designed fuse will nevertheless transmit current across its terminals after the fuse breaks. Despite there being no fuse element between the terminals of the fuse, the arc energy and outgassing that coincides with the breaking of the fuse may cause residue, such as electrically conductive residue from the fuse element, to remain within the fuse housing. When this occurs, there may be an electrically conductive path formed along the debris path that is sufficient for current to travel across the terminals. This phenomenon is known as creeping and causes the fuse to have a low OSR rating. Further, a low OSR rating means that the fuse has not fulfilled its intended purpose: to prevent damage to other components in the circuitry, due to the current still traveling across the fuse despite the fuse element being broken.

When a fuse is broken, due to an overcurrent condition, hot gases are created by the sudden appearance of an arc. The temperature of the arc may be greater than 6000 ° C. up to 20,000 ° C. during the interruption, for example. The suddenly increased air temperature, hot gases, and molten material create a significant pressure increase (shock wave) inside the fuse housing that will try to exit the housing very quickly, if possible. The molten material results from the breaking of the fuse element, or the heating of the fuse terminals, a busbar to which the fuse is connected, or other conductive material nearby. The housing plastic itself, when exposed to these same violent gases, will turn into carbon, which is semi-conductive. The resulting explosion of outgassing materials inside the fuse is thus a combination of hot gases, molten materials, and carbonized plastic materials.

The fuse may operate without vents, such that all the outgassing material stays within the housing of the fuse. This may be preferred in some environments where the messy aftereffects of the blown fuse are to be avoided. However, all molten material (from the copper element to the housing walls) will stay in the fuse. Particularly if the area around the fuse element is small, this may result in the fuse having too low an OSR (and unreliable fuse protection). But, if there is an opening somewhere in the fuse housing, the outgassing will exit there and the gases will transport molten and vaporized copper and carbonized semi-conductive plastic materials of the housing, to locations external to the fuse housing.

So, while some outgassing is acceptable (and even unavoidable) when the fuse breaks, to maintain a good OSR specification, the outgassing of the fuse should be reduced or controlled as much as possible. The vent channels 102 and labyrinth walls 104 of the novel fuse housing 100 are designed to strategically control the outgassing that occurs when the fuse breaks such that the OSR of the fuse remains very high. As illustrated in FIG. 2, the labyrinth walls 104 provide a serpentine path for the outgassing to flow out of the fuse housing 100. At the top edge of the labyrinth walls 104, the vent channels 102 provide an exit path for the outgassing.

Figure 3B:
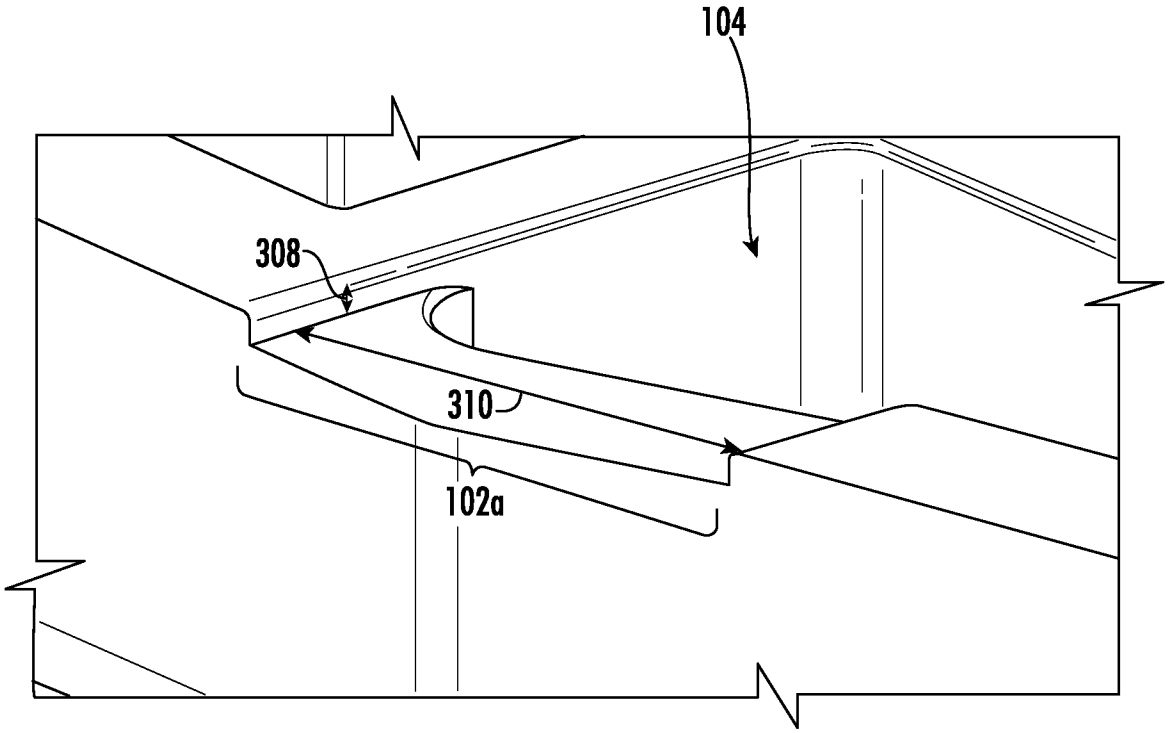
FIGS. 3A and 3B are diagrams illustrating a labyrinth wall and a vent channel, respectively, for the fuse housing of FIGS. 1A-1C, in accordance with exemplary embodiments.
Figure 3A:
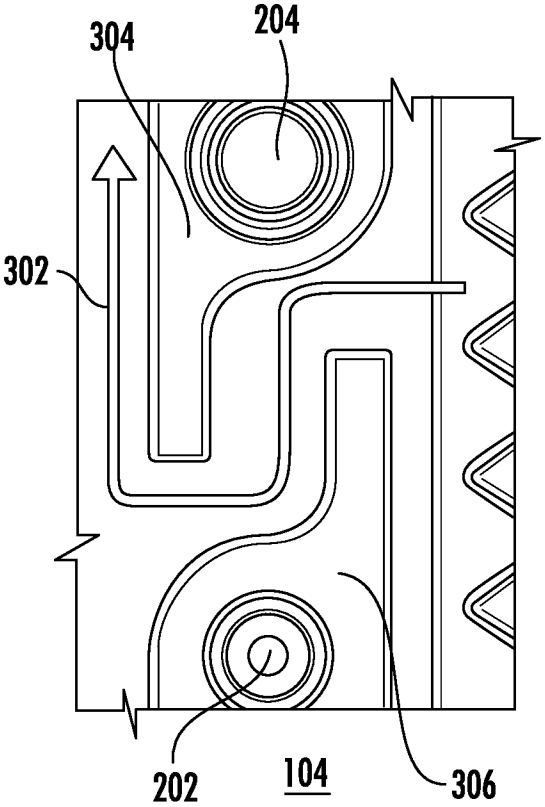

FIGS. 3A and 3B illustrate the left side labyrinth wall 104*a* and the left side vent channel 102*a*, respectively, of the fuse housing 100 of FIGS. 1A-1C in more detail, according to exemplary embodiments. The labyrinth wall 104*a* provides a current path 302 for the outgassing, as shown in the birds-eye view of FIG. 3A. While the explosion due to the arc energy begins in the center portion of the fuse housing 100 (FIG. 2) where the ribs 106 are located, the outgassing will quickly move to the labyrinth walls 104*a* and 104*b* on either side of the center portion. Raised structures 304 and 306 help to form the labyrinth walls 104*a*. Raised structure 304 is shaped somewhat like the small letter "p" of the alphabet (p-shaped) and features the cylindrical protrusion 204, which is disposed on top of the raised structure. Raised structure 306 is shaped somewhat like the small letter "d" (d-shaped) and features the receiving aperture 202, which is disposed on top of the raised structure. Similarly, as shown also in FIG. 2, raised structure for the right side labyrinth wall 104*b* is shaped somewhat like the small letter "q" (q-shaped) and features the receiving aperture 202*b*, which is disposed on top of the raised structure. Raised structure for the right side labyrinth wall 104*b* is shaped somewhat like the small letter "b" (b-shaped) and features the cylindrical protrusion 202*b*, which is disposed on top of the raised structure. The raised structures 306 may be formed, along with the other structures of the fuse housing 100 describe above, as a unitary structure by a molding process when the fuse housing is manufactured.

The labyrinth walls 104 are used to direct and spread particles and gases of the outgassing material. The serpentine path of the labyrinth walls 104 allows the resulting debris to stick to more surfaces, which, in some embodiments, helps to reduce the build-up of conductive material and conductive paths, thus improving the OSR of the fuse housing 100. Further, in exemplary embodiments, the vent channels 102, disposed at the farthest end of the serpentine path from the fuse element 114, are narrower in depth than that of the serpentine paths of the labyrinth walls 104, facilitating a suctioning effect during outgassing.

The fuse housing 100 includes the top portion 110 that secures to the bottom portion 108, as illustrated in FIGS. 1A-C. When the top 110 and bottom 108 structures are secured to one another, the raised structures 304 and 306 provide a path, given by the current path arrow 302 in FIG. 3A, to allow the outgassing to move in the desired direction toward the vent channels 102. A perspective view 300 of the vent channel 102 in FIG. 3B further illustrates the relationship between the labyrinth walls 104 and the vent channels 102. In an exemplary embodiment, the volume of space available as a path for outgassing in the labyrinth wall 104 is large relative to the depth of the vent channel 102, which is small. Nevertheless, this relatively small exit path of the vent channel 102 attracts the outgassing materials, in some embodiments, because the outgassing material is under very high pressure and the vent channel 102 provides an opening that relieves the pressure inside the fuse housing 100. The vent channel 102 and the labyrinth walls 104 are thus designed so that the central portion of the fuse housing 100 is more quickly cleared of debris.

In exemplary embodiments, the labyrinth walls 104 cools the outgas sing material as it travels the serpentine passages of the walls formed by the raised structures and leaves the fuse housing 100 through the vent channels 102. The labyrinth walls 104 may thus be thought of as mufflers of the outgassing material.

The labyrinth walls may be modified in a variety of ways. The labyrinth walls may be replicated, side by side, one, two, three, or more times, depending on the size of the fuse housing. Or, the shape of the labyrinth walls may be changed. Or, the edges of the "p" portion, the "d" portion, the "q" portion, and/or the "b" portion may be modified, such as by adding "teeth", "zigzags", scallops, and so on. Fuse designers of ordinary skill in the art will recognize a number of different ways in which the design of the labyrinth walls may change, while still providing the outgassing protection described herein.

In the simplified perspective view of the left vent channel 102*a* of FIG. 3B, the vent channel 102 has a depth (e.g., height) and a length 310. When the top portion 110 and bottom portion 108 of the fuse housing 100 are attached together, the vent channel 102 provides a gap of depth 308 for the escape of outgassing material. The gap creates a path of least resistance for the pressure of the arc episode that occurs when the fuse element 114 breaks to escape. The internal cavity pressure builds during the arc episode and exits to the environment through the vent channel 102. Further, the smallness of the vent channel 102 creates a suction-like effect that draws the outgassing materials toward the vent channel. Because the molten metal is heavier than the gaseous material, the molten metal will stay on the walls of the labyrinth walls 104 and the gas will escape out the vent channel 102, in exemplary embodiments.

In exemplary embodiments, the depth 308 of the vent channel 102 is kept somewhat small, relative to the depth of the labyrinth wall 104. This relatively small depth prevents too much debris from exiting the fuse housing 100 while nevertheless allowing some outgassing materials to escape and escape very quickly. In an exemplary embodiment, a large quantity of gaseous materials can exit the vent channel 102 while only a small amount of molten material escapes.

Figure 4A:
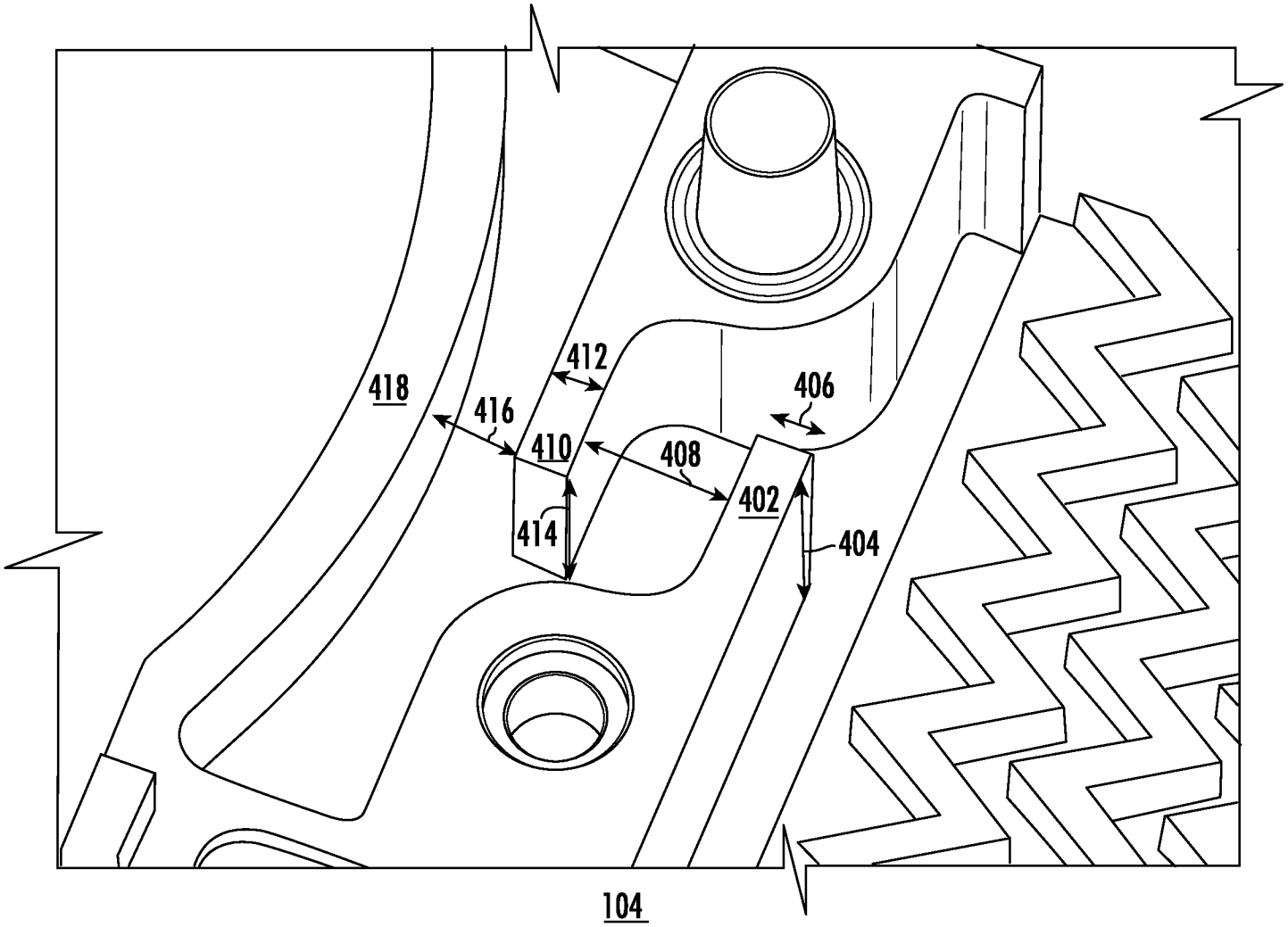
FIGS. 4A-4C are diagrams illustration exemplary dimensions for the fuse housing of FIGS. 1A-1C, in accordance with exemplary embodiments.
Figure 4B:
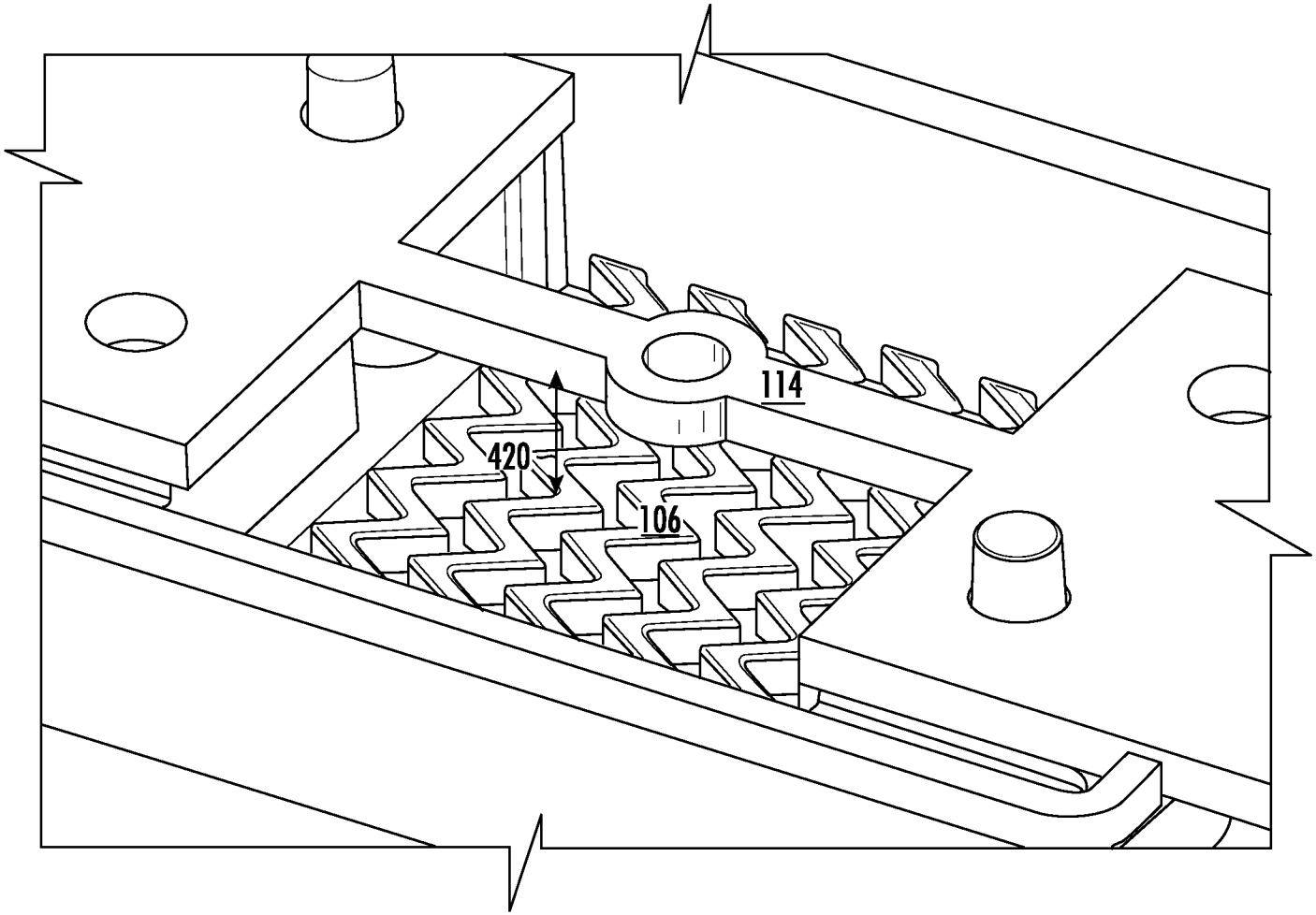
Figure 4C:
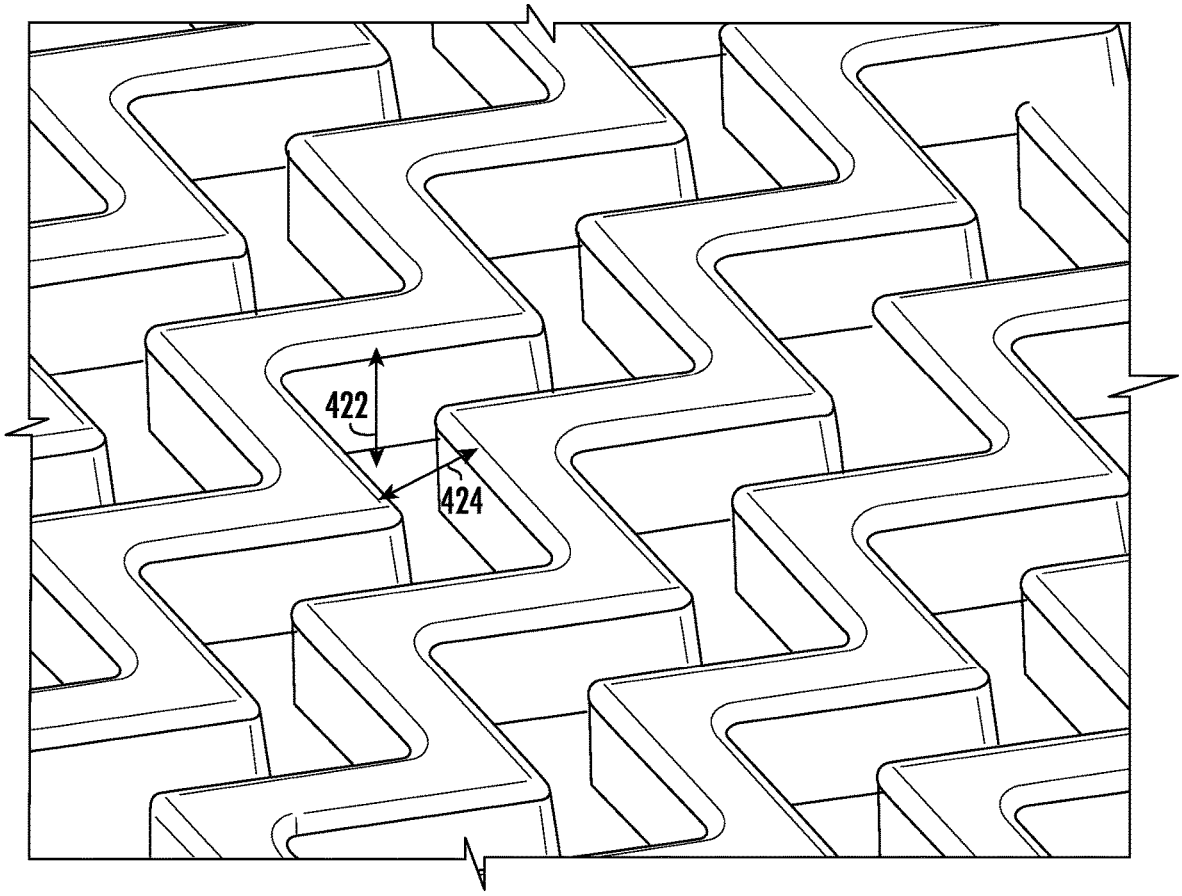

FIGS. 4A-4C are representative illustrations of the labyrinth walls 104 and ribs 106 including exemplary dimensions of each, according to some embodiments. FIG. 4A shows that, in exemplary embodiments, the dimensions of the labyrinth walls 104 vary. A first wall portion 402 (entrance wall or right wall) is on the right, a second wall portion 410 (center wall) is in the middle, and a third wall portion 418 (exit wall or left wall) is on the left. In exemplary embodiments, the distance 408 between the first wall portion 402 and the second wall portion 410 is greater than the distance 416 between the second wall portion 410 and the third wall portion 418. Further, in exemplary embodiments, the depth 404 of the first wall portion 402 is greater than the depth 414 of the second wall portion 410. Further, in exemplary embodiments, the width 406 of the first wall portion 402 is the same as the width 412 of the second wall portion 410. Thus, in exemplary embodiments, while both walls 402 and 410 are the same thickness, the distance between the walls reduces as the path of the labyrinth walls 104 gets closer to the vent channel 102.

FIGS. 4B and 4C illustrate dimensions of the ribs 106 and, in the case of FIG. 4B, their distance from the fuse element 114. In an exemplary embodiment, the depth 422 of the ribs 106, the distance 424 between ribs 106, and the distance 420 between the ribs 106 and the fuse element 114 (FIG. 4B) can vary. The dimensions 420, 422, and 424 do not affect the operation of the novel fuse housing disclosed herein.

In exemplary embodiments, the depth 308 of the vent channel 102 is small, relative to the depth of the labyrinth walls 104, so as to encourage very fast outgassing of debris from the fuse housing. In one embodiment, the depth 308 of the vent channel 102 (FIG. 3B) is about one fifth the width 406 of the first wall portion 402 or the middle wall portion 410 (FIG. 4A). In another embodiment, the length 310 of the vent channel 102 is about the same as the depth 414 of the center wall 410. In another embodiment, the length 310 of the vent channel 102 is about twice the distance 416 between the center wall 410 and the left wall 418. In another embodiment, the distance 408 between the right wall 402 and the center wall 410 is about 80% of the length 310 of the vent channel 102. In exemplary embodiments, the dimensions of the features of both the vent channels 102 and the labyrinth walls 104 are scalable to any size of fuse housing.

FIGS. 4A-4C provide some relative information for the labyrinth walls 104 and the ribs 106, according to some embodiments. The dimensions of the novel fuse housing 100 disclosed herein may nevertheless be scaled for different applications. Adjustments to the size of the rib chamber 116, left labyrinth wall chamber 118, and right labyrinth wall chamber may be made. Or adjustments to the height or width of the ribs 106, features of the labyrinth wall 104, or the vent channels 102, may be made.

By combining the two features of the fuse housing 100, the vent channels 102 and the labyrinth walls 104, the performance of the fuse is controlled, in some embodiments, through the venting that takes place and control of the OSR. The vent channels 102 and labyrinth walls 104 help to direct the outflow of gases caused by the arc following the overcurrent condition. The novel features (vent channels 102 and labyrinth walls 104) further control the outflow of the gases by the combination of a serpentine path of the labyrinth walls 104 and the thin gap of the vent channel 102 for the expulsion of outgassing material. The vent channels 102 and labyrinth walls 104 further help to reduce the high temperature of the gases in the outgassing material, in some embodiments, by creating a path for their quick movement and an exit path through the fuse housing 100. Further, in exemplary embodiments, the vent channels 102 and labyrinth walls 104 of the fuse housing 100 reduce the effects of outgassing (visible hot gases, blackened surroundings) because, on the way out of the fuse housing, the gases deposit copper (of the fuse element) and graphite (carbonized plastic of the housing) on the labyrinth walls.

Figure 5:
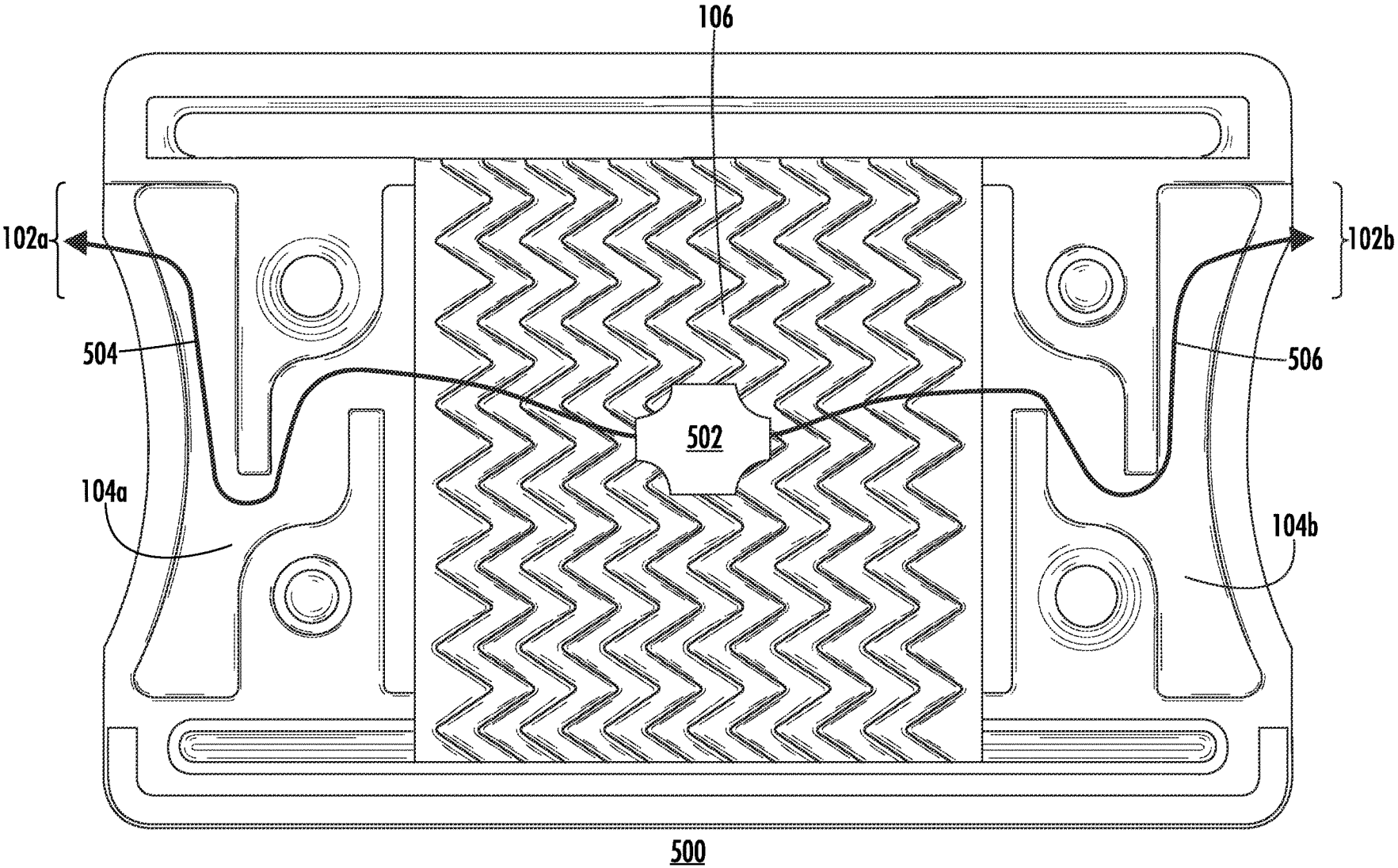
FIG. 5 is a diagram illustrating a debris path for the fuse housing of FIGS. 1A-1C, in accordance with exemplary embodiments.

FIG. 5 is a birds-eye view of either the bottom portion 108 or the top portion 110 of the fuse housing 100 of FIGS. 1A-1C, according to exemplary embodiments. A location 502 of the initial arc episode (fuse element explosion) is shown, along with a left path 504 and right path 506 for the outgassing to occur. When the fuse blows, the buildup of pressure at the center arc episode location 502 is going to escape, some along the ribs 106, some within the labyrinth walls 104, and some through the vent channels 102. The serpentine path of the labyrinth walls 104 creates a long exit path to those vent channels 102, with much of the debris of the outgassing depositing onto the walls of the labyrinth walls, and, ideally, less so on the ribs 106 in the center portion of the fuse housing 100. In other words, the design of the fuse housing 100 with the labyrinth walls 104 and the vent channels 102 at left and right sides of the housing is designed to cause the debris that contains the conductive material to be spread as far away from the arc explosion location 502 as possible. In exemplary embodiments, this ensures that conductive material does not collect in a manner to allow a current to flow between the two sides of the fuse housing, preserving a high OSR rating for the fuse, and allowing the protective operation for which the fuse element 114 within the fuse housing 100 is designed.

In an exemplary embodiment, the thickness of the housing walls behind the ribs 106 is 0.6 millimeters (mm) while the thickness of the ribs is 0.9 mm. Thus, while material is deposited on them, the ribs 106 are not thick enough to block egress of the outgassing material toward the labyrinth walls 104. In an exemplary embodiment, the distance from the fuse element 114 to the top of the ribs 106 is sufficient that the ribs do not block the outflow of gases. The ribs 106 thus hide and distribute the conductive copper and plastic between each row of ribs.

Figure 6:
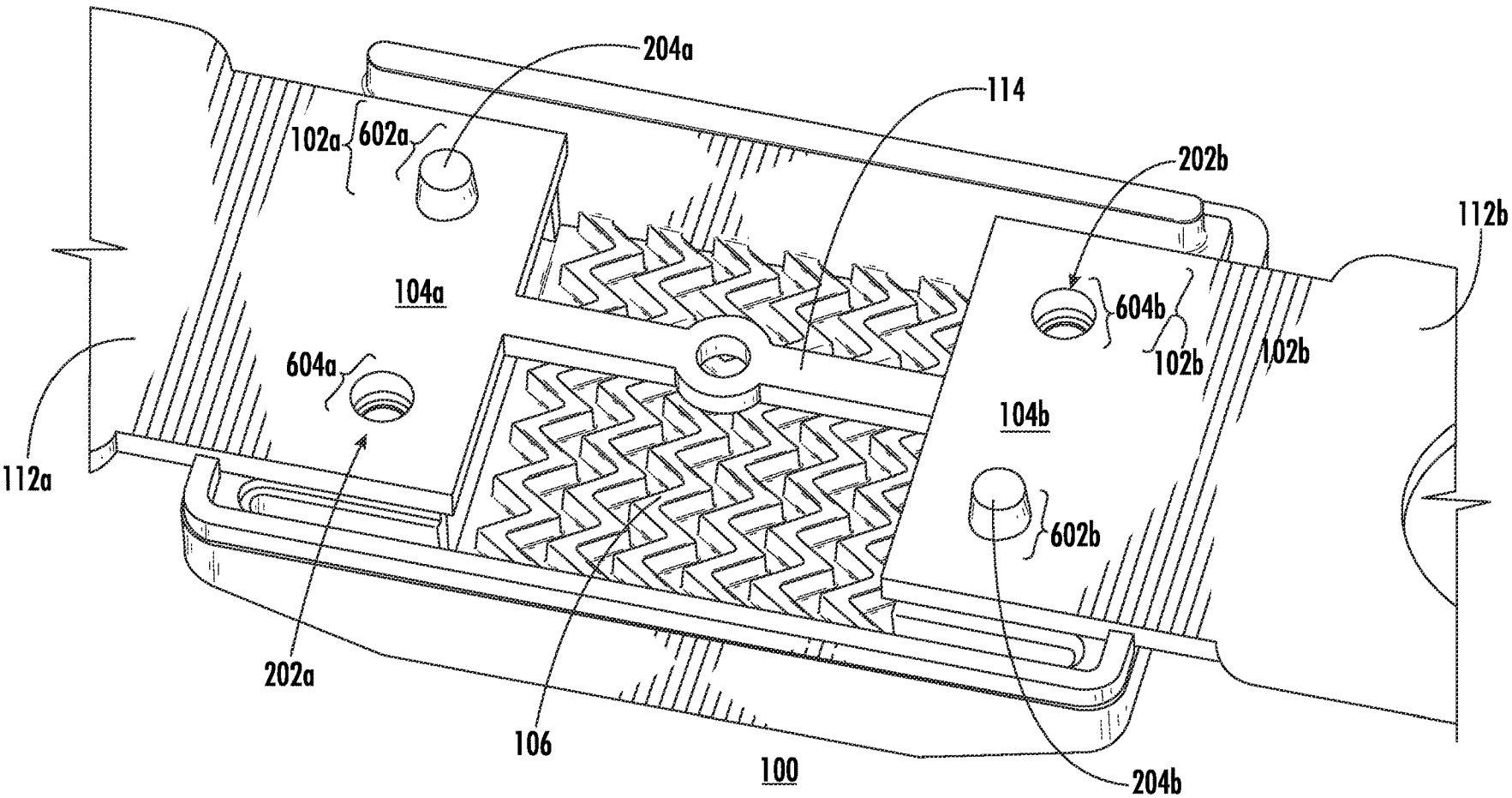
FIG. 6 is a diagram illustrating the fuse housing of FIGS. 1A-1C, in accordance with exemplary embodiments.

FIG. 6 is a perspective view of the fuse housing 100 featuring the fuse element 114, in accordance with exemplary embodiments. The left terminal 112*a* is connected to the fuse element 114 on a left side of the fuse housing 100, while the right terminal 112*b* is connected to the fuse element on a right side of the fuse housing 100. The fuse element 114 is centrally located within the fuse housing 100 and disposed above the ribs 106. The fuse element 114 is the "intentional weak point" of the fuse, designed to break at the rated voltage. In one embodiment, the fuse element of a 48V electrical circuit will break when an overcurrent causes the maximum voltage of the circuit to exceed 70V. The fuse element 114 as well as the terminals 112 are made of an electrically conductive material, such as copper, though the terminals are made thicker and more robust than the fuse element (by design). When the arc episode occurs due to the overcurrent condition, the fuse element 114 will be destroyed while the terminals 112 are merely damaged.

In FIG. 6, the portion of the terminals 112 that are disposed over the fuse housing 100 is shown as partially transparent, such that the vent channels 102 and labyrinth walls 104 are somewhat visible. In addition to securing the bottom portion to the top portion of the fuse housing 100, the cylindrical protrusions 204 and the receiving apertures 202 also facilitate placement of the terminals 112 to the bottom portion of the fuse housing. The terminals each include two apertures for this purpose. The left terminal 112*a* includes apertures 602*a* (used) and 604*a* (unused), while the right terminal 112*b* includes apertures 602*b* (used) and 604*b* (unused) (collectively, "apertures 602" and "apertures 604"). Further, the receiving apertures 202 and cylindrical protrusions 204 (FIG. 2) disposed beneath each terminal provide support for the placement of the terminals 112.

FIG. 6 further shows that, in exemplary embodiments, a portion of each terminal 112 is disposed within the fuse housing 100 directly over the labyrinth walls 104 and vent channels 102. Thus, there will remain conductive material, the portions disposed within the housing, even after the fuse element 114 is blown. Further, this shows that the presence of conductive material within the labyrinth walls 104 is not of concern, given that the terminals also occupy this space. It is only the presence of conductive material within the center portion of the fuse housing 100 that is mitigated by the novel design features (vent channels 102 and labyrinth walls 104) described herein.

Figure 7:
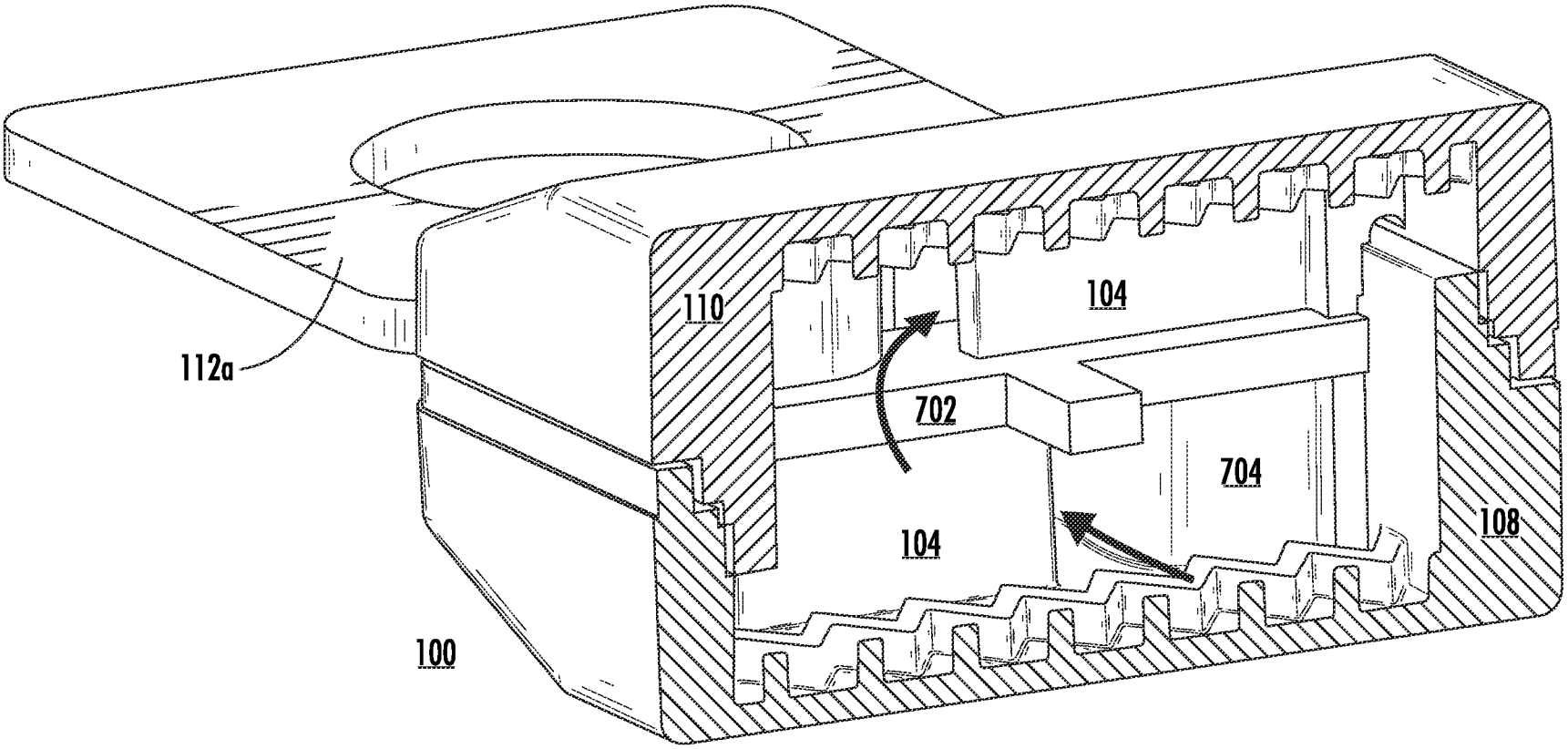
FIG. 7 is a diagram illustrating a cross-sectional view of the fuse housing of FIGS. 1A-1C, in accordance with exemplary embodiments.

FIG. 7 is a side cross-sectional view of the fuse housing 100 of FIGS. 1A-1C, in accordance with exemplary embodiments. The top portion 110 and the bottom portion 108 are shown, along with the left terminal 112*a*. Since the fuse housing 100 exhibits axial symmetry, the outgassing will travel both "under" the terminal 112*a* (and 112*b*) and "over" the terminal 112*a* (and 112*b*). When the fuse element 114 (not shown) is blown, a first debris path 702 travels above the left terminal 112*a* through the labyrinth walls 104. Similarly, a second debris path 704 travels below the left terminal 112*a* through the labyrinth walls 104.

Thus, due to the axial symmetry of the top portion 110 and the bottom portion 108, the outgassing has four path, as the outgassing will travel both "under" and 37 over the terminals 112: : 1) to the left of the fuse element 114, under the terminal 112*a*, through the labyrinth wall 104*a*, and out the vent channel 102*a* (of the bottom portion 108); 2) to the right of the fuse element 114, under the terminal 112*b*, through the labyrinth wall 104*b*, and out the vent channel 102*b* (of the bottom portion 108); 3) to the left of the fuse element 114, above the terminal 112*a*, through the labyrinth wall 104*a*, and out the vent channel (of the top portion 110) and 4) to the right of the fuse element 114, above the terminal 112*b*, through the labyrinth wall 104*b*, and out the vent channel 102*b* (of the top portion 110).

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse housing, comprising:

a fuse element;

a labyrinth wall disposed adjacent the fuse element, wherein the labyrinth wall is terminated by a vent channel;

a top portion comprising:

a cylindrical protrusion disposed in a first raised structure; and a receiving aperture disposed in a second raised structure, wherein the first raised structure and the second raised structure are disposed in the labyrinth wall to create a serpentine path for expulsion of outgas sing material; and a bottom portion comprising a second cylindrical protrusion and a second receiving aperture, wherein the fuse element is disposed between the top portion and the bottom portion;

wherein the cylindrical protrusion mates with the second receiving aperture and the second cylindrical protrusion mates with the receiving aperture once the top portion mates with the bottom portion.

2. The fuse housing of claim 1, further comprising:

a first plurality of ribs disposed adjacent the fuse element in the top portion; and a second plurality of ribs disposed adjacent the fuse element in the bottom portion.

3. The fuse housing of claim 1, wherein the labyrinth wall has a first depth and the vent channel has a second depth, with the second depth being substantially smaller than the first depth.

4. The fuse housing of claim 1, wherein the first raised structure is p- shaped and the second raised structure is d-shaped.

5. The fuse housing of claim 1, wherein the first raised structure is q- shaped and the second raised structure is b-shaped.

6. The fuse housing of claim 1, wherein the cylindrical protrusion, the second cylindrical protrusion, the receiving aperture, and the second receiving aperture further hold in place a terminal when the top portion is mated with the bottom portion.

* * * * *